US005960720A

United States Patent [19]

Borland et al.

[11] Patent Number: 5,960,720

[45] Date of Patent: Oct. 5, 1999

[54] DISPLAY PALLET

[76] Inventors: Curtis L. Borland, 203 E. 11th Ave., North Kansas City, Mo. 64116; Charles S. Snelling, 11712 E. 48th Ter., Kansas City, Mo. 64133; Stephen H. King, 302 N.E. 82nd Ter., Kansas City, Mo. 64118

[21] Appl. No.: 09/072,336

[22] Filed: May 4, 1998

[51] Int. Cl.[6] ..... B65D 19/38

[52] U.S. Cl. ..... 108/53.1; 108/91

[58] Field of Search ..... 108/53.1, 53.3, 108/55.1, 55.3, 901, 907, 57.25

[56] References Cited

U.S. PATENT DOCUMENTS

| | | | |
|---|---|---|---|
| 3,762,343 | 10/1973 | Thacker | 108/53.5 X |
| 3,868,915 | 3/1975 | Hafner | 108/53.1 X |
| 3,917,108 | 11/1975 | Thurman | 108/53.1 X |
| 3,926,321 | 12/1975 | Trebilcock | 108/53.1 X |
| 3,993,168 | 11/1976 | Kubick | 108/53.1 |
| 4,226,192 | 10/1980 | Myers | 108/53.1 |
| 4,263,855 | 4/1981 | Lawlor | 108/53.3 |
| 5,154,310 | 10/1992 | Massey | 108/53.3 X |
| 5,341,748 | 8/1994 | Liu | 108/53.3 |
| 5,755,162 | 5/1998 | Knight et al. | 108/53.1 |

*Primary Examiner*—Jose V. Chen

*Attorney, Agent, or Firm*—Spencer Fane Britt & Browne LLP

[57] ABSTRACT

The present disclosure relates to a device for displaying product and particularly to a display device that has feet distending from a perforated platform and spaced such that the device is accessible from all four sides by the tines of a pallet truck, hand truck, fork lift or other such handler device. This permits a display of product to be built onto such display device and then moved into the desired location such as the end-cap position in a grocery store. The display device also has sidewalls extending up from the platform to accommodate signage thereon. The feet of the display device have an opening for receiving the upper edge of the sidewall of a lower display device when the display devices are stacked vertically. This arrangement permits visual identification of any given display device as the signage on the sidewalls is always visible, it prevents damage to the exterior side wall as there is no one-inside-the-other nesting, and it allows for easy retrieval of any given display device within a vertical stack.

16 Claims, 3 Drawing Sheets

FIG. 2
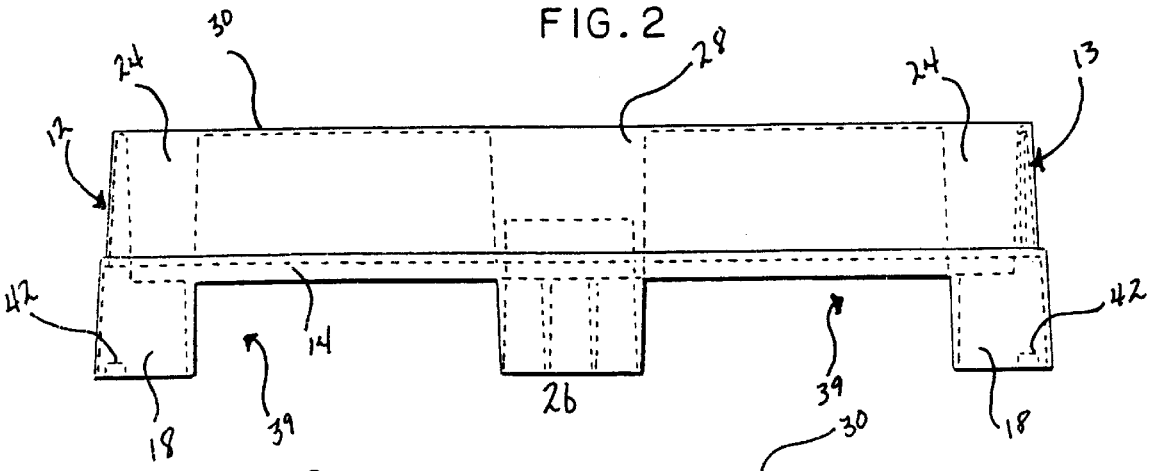
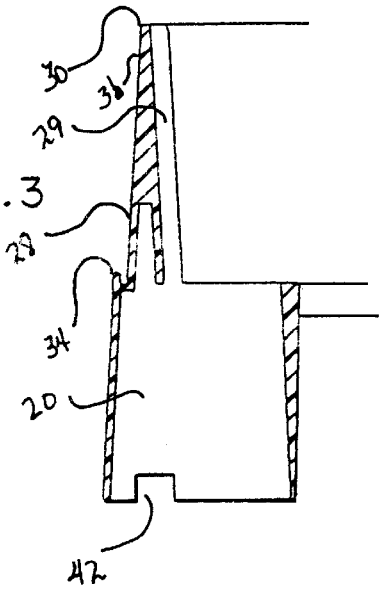
FIG. 3
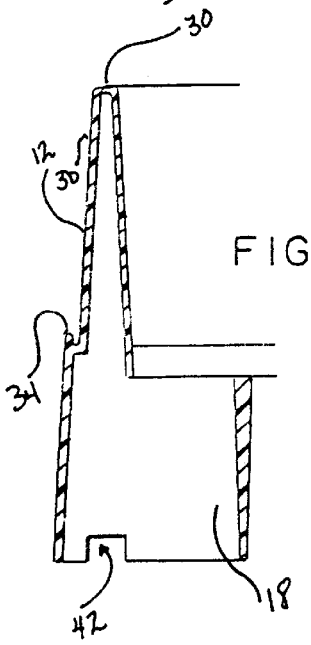
FIG. 4
FIG. 5
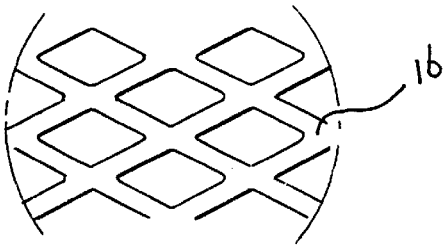

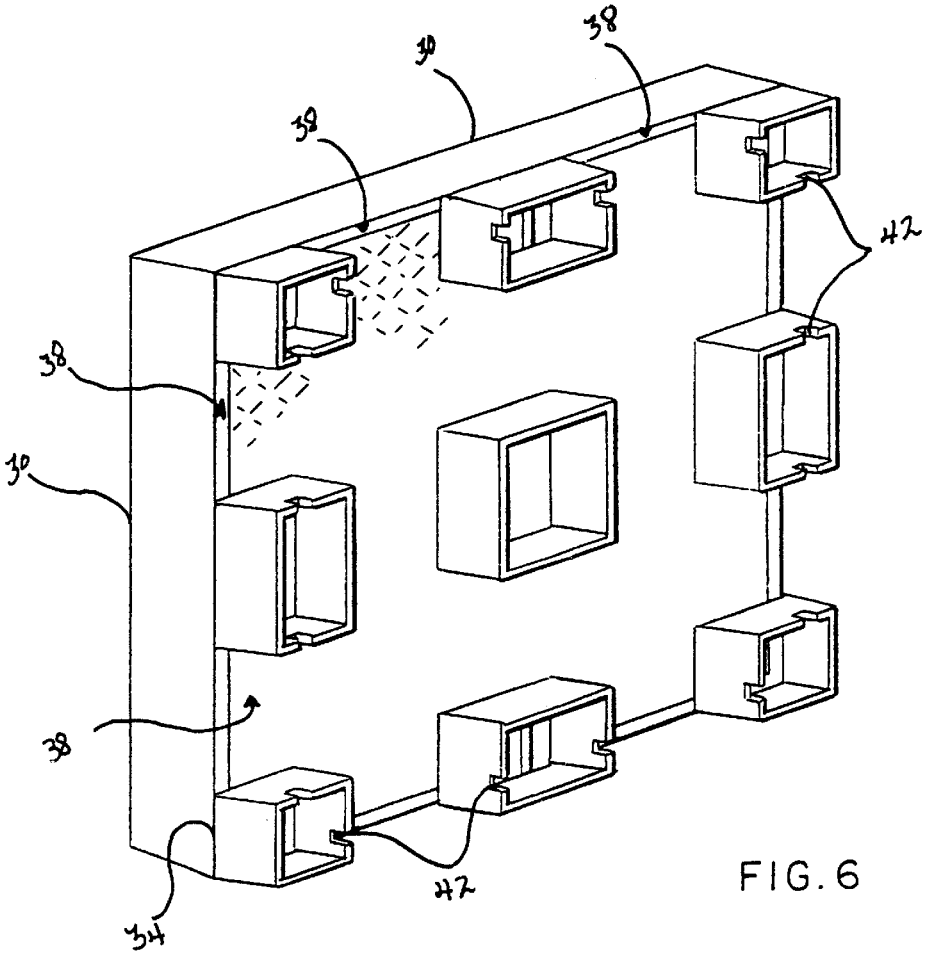
FIG. 6
FIG. 7
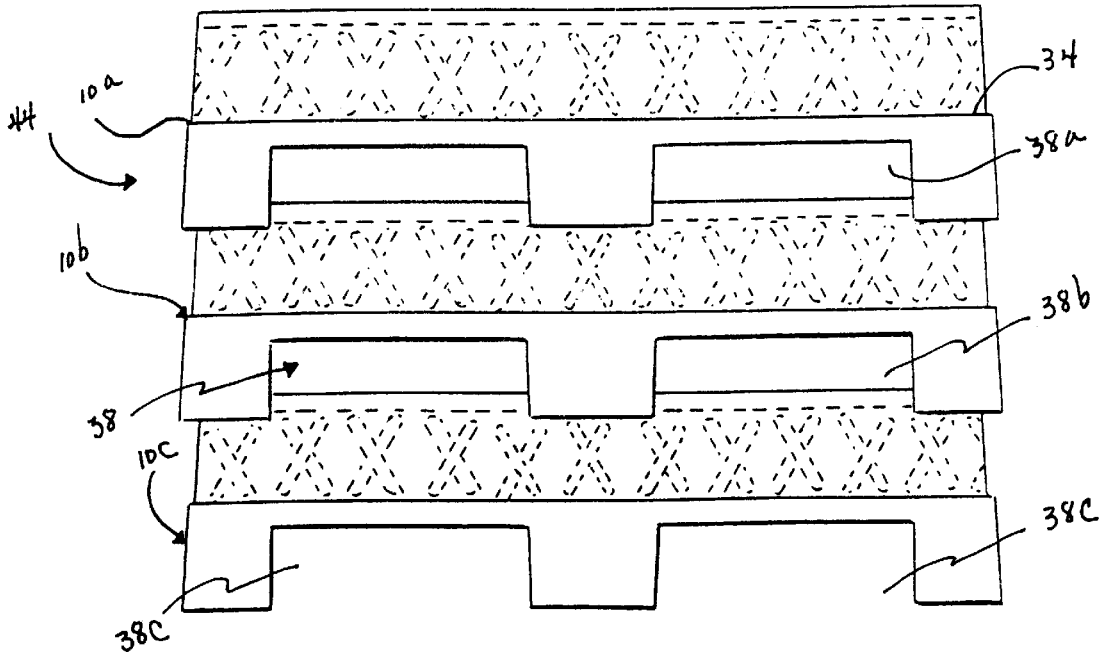

DISPLAY PALLET

BACKGROUND OF THE INVENTION

A. Field of the Invention

This invention relates generally to visually attractive, stackable display platforms or pallets for display of goods in a convenient, accessible, protective and attractive manner. More particularly, the invention relates to display platforms or pallets with side walls that protect the product displayed thereon from damage, facilitate the display of signage to promote the product or the source of the product, and engage with the feet of another such display platform when vertically stacked one upon another in a manner permitting easy visual identification of a particular platform within the stack and retrieval of a selected platform from the stack.

B. Description of the Prior Art

Because shelf space in grocery stores, convenience stores, and other mass merchandisers is necessarily limited, competition grows ever more fierce among sellers of goods for a place on those shelves. As a means of maximizing the available shelf space within a particular store and also taking advantage of impulse buying and sales promotions, stores have taken advantage of end-cap or free-standing displays. End-cap displays are displays set at the end of the aisle and aligned up against the traditional aisle shelves while free-standing displays are those that stand alone or at least are not intended to be associated with the shelving units at the end of an aisle. Such displays have proven highly successful in moving product because they are easily seen, easily accessible, and focus the consumers' attention on a particular product, manufacturer, and/or distributor.

Despite the desirability of such product displays, there has not to date been any display pallets available which accommodate the particular demands of such display positions. One such demand is the need to protect the product from damage. Free-standing displays or displays that are located at the end of an aisle where customers are making a turn to go to the next aisle are in the line of traffic, so to speak. It is therefore not unusual for shopping carts, strollers, feet, floor waxers, mops and the like to hit into the product in the display resulting in damage to the product container and possibly to the product itself. In addition, water, wax or other such substances are likely to wash up onto the product package and further cause damage that may leave the product unsaleable. A display platform is needed, therefore, that allows for easy accessibility of product yet provides protection to the product.

A side-effect of damaged product is the problem of product leakage or spillage. Where a product's package has been damaged, the product may leak down onto the floor of the display pallet. If the pallet floor is solid, the spillage will pool and damage other product containers sitting on the pallet floor. The same problem occurs if the product is placed directly on the floor and spills occur on the floor and spread to the product. Thus, a display pallet is needed that has a porous floor such that any leakage, drainage, or spillage of product above will drain through to the floor rather than pooling on the pallet floor, minimizing damage to other product on the pallet. Also, it is important to have a display platform or pallet that is supported some distance above the floor so that spillage on the store floor will not reach the product, drainage or leakage from the product will have a place to dissipate, and there will be some ability to clean under the pallet. Use of outside displays, such as those displaying beer, soda pop, or the like, near the gas pumps of mini-marts, demonstrate another need for a pallet that will not only provide drainage through the pallet floor in the case of inclement weather such as snow or rain, but will always be durable and remain attractive when exposed to sunlight and vast changes in temperature.

Another significant demand of such end-cap or free-standing displays is the ability to build the display out of the consumers' presence and then move it quickly into place in the store. In an effort to accommodate customers' busy schedules, many stores are open twenty four hours per day or at least long day and evening hours. Therefore, there is little, if any, time where displays can be built on the sales floor without interfering with the free movement of customers, not to mention that it is preferable not to perform such custodial tasks as building displays in full view of customers. Therefore, a display platform which can be assembled in the "back room" and then quickly and efficiently moved into place by means of a hand truck, pallet jack, or other such handler would be highly desirable.

In addition, displays which are intended to draw the consumers' attention and close a sale should be attractive and offer information about the product and price that will entice the customer. The ability to identify the product, price, source of the product, or owner and supplier of the display platform directly on the platform not only facilitates sales and name recognition on the part of the customers, but such labeling also identifies the owner or provider of such display platforms. This can be important not only to prevent theft of such display platforms, but manufacturers may wish to purchase platforms and supply them to the stores so that they may be more likely to get display positions and/or at least name exposure to the customers.

Available space is not only a problem on the sales floor, but also in the store room. Therefore, it is important that any such display platforms stack in an efficient and easily retrievable fashion. It is well known to "nest" pallets such that the pallets may be stacked vertically. Such nesting configurations typically involve one pallet fitting inside the other in some respect, thus creating a stable stacking configuration. Where a pallet or platform is intended for display, however, it is important that the platform itself be attractive and free from damage. When pallets are nested within each other there is damage to the pallet fitting "inside" due to scraping of the surface. This creates a particular problem where the display platform has signage on its outer face. No company would be pleased to have invested the money for an attractive display platform touting their name only to have that proprietary signage disfigured. Therefore, what is needed is a display platform that is affordable; made of material that is durable and provides an attractive, easily cleanable surface; and one that will nest or stack in a manner which will not adversely affect its appearance.

Traditional wood stringer pallets are the types of pallets most often used by merchandisers for end-cap and/or free-standing product displays. These pallets have many disadvantages, however. First, these pallets are not attractive by any stretch of the imagination. In fact, they are intended for use in transporting product on trucks or rail cars or for storage of products in a warehouse, and they look the part. Stores go to great lengths to compensate for this unattractiveness, painting the pallets or even wrapping them in decorated paper to completely disguise them from view. Needless to say, such efforts are expensive both in dollars and in time. Even decorated, these wood pallets leave a lot to be desired.

Recently there have been environmental concerns relating to wooden pallets as well. These pallets break down, become discarded, and clutter the environment. Wooden pallets also have sanitation problems as food and water spills and leakage can seep into the grain of the wood where bacteria forms creating health hazards. Such wooden pallets can never be completely cleaned and thus present a health and odor problem for retail stores using wooden pallets for display purposes. For more information on the disadvantages of using wooden pallets, see for example, "Wooden pallets present environmental concern," *The Kansas City Star,* Apr. 11, 1998, at B-1 and B-3, col.1.

The typical grocery store wood-stringer pallet, commonly called a GMA (Grocery Manufacturing Association) pallet is standardized at forty inches by forty-eight inches principally to comport to the dimensions of semi-trailers, warehouse racking configurations, and to achieve a standard dimension so that pallets may be freely exchanged between various vendors. When used as a display pallet, one or more pallets are typically aligned on the floor with their forty-eight inch sides abutting the end of the store shelving unit. Due to the stringers running across the forty-eight inch length, these pallets are inaccessible by a pallet jack, hand truck, or other such handler device from the "front" of the display. Because the aisles between adjacent store shelves are restricted in size, it is typically impossible to maneuver the handler to a position where the pallet can be lifted from its forty inch side. This means that the pallets must be first decorated (to disguise their unattractiveness), then set into the desired location on the sales floor, the product is then wheeled out onto the sales floor on a hand truck, and the display is "built" or loaded with product in its place of display.

As discussed previously, this process consumes time, money and necessitates either inconveniencing customers while such displays are being built or requiring employees to stay after closing hours to build the displays. Again, it is demonstrated that what is needed is a display that is: attractive without the need for additional and expensive decor; easy to clean; durable; and accessible from all four sides with a hand-truck or pallet jack so that the display thereon may be created or built in a back room and then quickly and easily moved into place on the sales floor.

The other type of display device used for display of goods on end-caps or free-standing on a store's sales floor are simple display stands. Such display stands are typically trays or platforms, standing flat or nearly so against the floor on all sides, having no means for entry on any side by a pallet jack or hand truck. These platforms do not have side walls extending up from the display stand floor to protect the product from external damage.

Therefore, it would eliminate a number of problems and be a great benefit to retailers and other merchandisers to have available a display pallet which could be easily cleaned and even sterilized. Further, a pallet which permitted cleaning of the area underneath the pallet while the pallet was loaded, and which protected the lower levels of product situated on the pallet would also solve a significant problem for retailers.

U.S. Pat. No. 3,917,108, to Thurman, incorporated herein by reference, teaches a tray of this type. While indicated in Thurman at col. 1, lines 7–11, that molded plastic trays of this type may be of many different shapes or configurations, it is taught that the preferred embodiment "has shallow side walls which terminate in a horizontal flange (col. 2, lines 21–23). As such, it would not be obvious either to extend the sidewalls upwardly to include signage nor to add feet to allow for lifting and moving of the tray by a pallet handler such as a pallet jack or pallet truck. Indeed, as noted in FIGS. 1 and 2–5, the trays of Thurman have no feet and rest directly on the floor or other surface on which they are posited. There are no insertion points where tines of a pallet handler could be introduced to move the tray into place on the sales floor. In fact, Thurman teaches away from extended side walls or feet as one of the main goals of Thurman in designing and making such trays is to minimize costs by minimizing the quantity of plastic material (Col. 1, lines 13–17). There is no indication in Thurman of a means for vertically stacking such trays.

Moreover, even if these trays were capable of being vertically stacked, there is no teaching of avoiding contact between the outside face of one tray and the inside of a nesting tray so as to avoid scratching or marring. Nor is there any teaching in Thurman that would make obvious adding feet or other means such that a particular tray could be identified and retrieved from a vertical display by, for example a forklift.

The patents to Flum, U.S. Pat. Nos. 4,653,651; 4,801,024 and 4,750,623 teach stackable display trays formed to engage the particular product being stacked thereon, in particular, beverage containers such as two liter bottles or six-packs of bottles. Flum recognizes the desirability of associating signage capabilities with the display unit ('623 and '651, 203, FIG. 19; '651, 208, FIGS. 23–24). The signage means taught in Flum, however, requires additional elements such as frame members or rods ('623 and '651, 180 and 182, FIG. 19; '651,210, FIG. 23), extending vertically above the uppermost shelf members 14 or 156, respectively. These frame members or rods are particularly adapted for storage of unused shelf members and have the disadvantage of requiring more floor space for the display device because of the space taken up by the frame members, the rods, the stored shelves; and, in yet another embodiment, the holding member 16 ('623 and '651, FIG. 6).

In addition to taking up space by, for example, requiring the display unit to stand out from the wall or shelf aisle against which it is placed, these additional elements add to the cost of the display device, requiring more molds, more expense for the molding process, more plastic. As previously mentioned, cost and space are valuable commodities in the merchandising business.

It would be more advantageous to provide signage right on the display shelves themselves. Flum acknowledges the need for extended side walls so as to minimize damage to product displayed thereon ('651 at col. 7, lines 21–28; '623 at col. 6, lines 34–42), but, because the display devices of Flum rely on the ability to efficiently nest the display shelves on support members at the back of the display unit, Flum teaches away from the idea of extending the sidewalls sufficiently upward to accommodate any meaningful signage. Moreover, any signage carried on the outside of the sidewalls in Flum would necessarily become marred and damaged due to the one inside the other nesting arrangement disclosed. Thus, once again, such display stands fail to meet the needs and requirements for in-store sales display devices.

Even in considering pallets used outside of the area of display devices, there are no desirable alternatives offered or suggested. Patents to Evans (U.S. Pat. No. 5,429,236); Anaelbeck (U.S. Pat. No. 3,636,888); Knight et al. (U.S. Pat. No. 5,408,927); Sanders et al. (U.S. Pat. No. 4,183,491); Pike (U.S. Pat. No. 3,680,495); and Griffen (U.S. Pat. No. 4,000,704), all incorporated by reference herein, are plasticized pallets intended for shipping and transport of product, not for display. As such, these pallets have no suggestion to extend their sidewalls to incorporate signage thereon, and in some cases, extension of the sidewalls would interfere with the ability to on and off load the containers or other large loads being carried thereon, for example see the patent to Angelbeck. Even if signage were to be included on extended sidewalls, the nesting arrangements suggested in these patents would once again cause marring and damage of the sidewalls when the pallets were vertically stacked.

In addition to resulting in damage to the face of the pallet, as mentioned previously, one-inside-the-other nesting restricts the ability to see the signage on any particular pallet when the pallets are nested and stacked vertically. This means of nesting also inhibits the ability to selectively separate the stack at any given pallet so as to retrieve it from the stack, as there are no openings for a fork lift or similar device to enter when the pallets are nested. The patent to Pike recognizes this problem and teaches the desirability of a space between the marginal edge portions of adjacent pallets when stacked vertically to permit easy entrance for the tines of a fork lift (col. 2, line 63 to col. 3, line 2).

While some space is provided at the outer corners of Pike for insertion of a fork lift tine, there is no suggestion for extension of the side walls for signage and thus no ability to identify any given pallet within the stack. Of course, there is no need for these features in Pike, as the invention is directed to use in transporting various goods, not displaying them. As discussed, it is desirable for a display pallet to have extended sidewalls designed to carry signage thereon.

This signage could be proprietary to particular manufacturers of goods. For example, a beverage company may wish to have its logo placed on display devices which it then provides to grocery stores for display of its products. Similarly, a cereal manufacturer may provide display devices with its logo, and so on. The store, as a matter of efficiency and conservation, would stack these display devices for storage when not in use. It would be desirable to have a display device that could be readily identifiable and retrievable from the stack so that the merchandiser could quickly and easily set up any display desired on the appropriate display device.

Another problem with the pallets that nest one within the next when vertically stacked, is the difficulty in separating two adjacent pallets. These pallets are typically quite heavy. As the foot of one pallet nests inside either the foot or the rim of an adjacent pallet, the weight of that pallet, as well as those stacked above, will wedge the pallets tightly together. This phenomenon will be appreciated by anyone who has tried to pry apart two plastic food storage bowls or two plastic glasses that have been nested, one inside the other. Even with the spacing provided for in Pike, the nesting of the one pallet inside the other will make it difficult to separate two pallets. Imagine a fork lift, reaching up in the stack, placing its tines in the open spaces formed between two of the Pike pallets, and lifting upwardly. Likely, several other pallets beneath the one selected will lift as well. As those are then moved off the pile, there is a very real danger that the pallets merely hanging on for the ride may let loose, fall, and could even injure someone, as well as doing damage to the pallet itself. One would most likely need to hold down on the pallet rim of pallet below the one being lifted to insure that the pallets were properly separated. What is needed therefore, and solved by the present invention, is a pallet that will stack in a manner that does not create this sticking."

The patent to Andersson, U.S. Pat. No. 4,478,156, offers another possible solution to the problem of separation of adjacent pallets when nested and vertically stacked. Again, however, Andersson has the disadvantage of one-inside-the-other nesting where there is scraping and marring of the exterior walls of the inner pallet where the legs of the nesting pallet fit over it. While there are adequate areas in which handler tines may access a given pallet, the way that the pallets nest one inside the other will result in the same "sticking" together of adjacent pallets in a stack. Further, the design of the Andersson pallet, with support legs on only two of the four sides of the pallet, would not be capable of achieving the weight-bearing strength necessary to hold heavy loads of product, such as 24-can cases of soda or beer. Without support on all four sides, a pallet according to Andersson of any significant size would likely bow in the middle when carrying such a weighty load.

From the foregoing, it will be appreciated that what is needed in the art is a display device for attractively and conveniently displaying product at the point-of-sale wherein the display device is accessible from all four sides by means of a fork lift, pallet truck, hand truck or other similar handler device a means; has signage incorporated on the face of the display device, and has the ability to nest the display devices one on top of the other in a vertical stack without excessive marring or scratching of the adjacent display devices.

Accordingly, it is a primary object of the present invention to provide a display device for displaying product that is strong, attractive, easy to clean, and accessible by a handler device from all four sides so that the device may be loaded with product and then readily moved into the place of display;

It is another object of the invention to provide a display device that has signage incorporated on its outside face;

It is a further object of the present invention to provide display devices that can be efficiently and easily stacked one on top of the other to create a vertical stack wherein the signage displayed on each such device is visible and readily identifiable;

It is a still further object to provide display devices that can be selectively lifted and removed from a vertical stack of similar devices by easy insertion of the tines of a handler device;

It is another object to provide display devices and a means for the vertical stacking of same that will not excessively mar, scratch or otherwise damage the exterior surface of adjacent display devices in the stack.

It is yet another object of the present invention to provide display devices that will not stick to one another requiring prying apart to separate when such devices are vertically stacked.

The foregoing and other objects are not meant in a limiting sense, and will be readily evident upon a study of the following specification and accompanying drawings comprising a part thereof. Other objects and advantages of this invention will become apparent from the following description taken in connection with the accompanying drawings, wherein is set forth by way of illustration and example, an embodiment of this invention.

SUMMARY OF THE INVENTION

The present invention relates to a device for displaying product. More particularly, the invention provides a display device that has feet, distending from a perforated platform, said feet spaced such that the device is accessible from all four sides by the tines of a pallet truck, hand truck, fork lift or other such handler device. Thus, the display of product may be built onto such display device and then moved into the desired location.

The display device of the present invention also has sidewalls, extending up from said perforated platform to accommodate signage thereon. Said feet having an opening for receiving the upper edge of said sidewall when the display devices are stacked vertically. This arrangement permits visual Identification of any given display device as the signage on the sidewalls is always visible, it prevents damage to the exterior side wall as there is no one-inside-the-other nesting, and it allows for easy retrieval of any given display device within a vertical stack. The display devices are not nested, as such, but rather "piggy-backed" one atop the next within a vertical stack. Therefore, any one particular display unit may be lifted off its supporting member in the stack, without the need to "pry" apart adjacent pallets that have become "stuck" due to one nesting within the other.

DESCRIPTION OF DRAWINGS

FIG. 2 is a side-elevational view of the display base of FIG. 1 with the interior platform surface and interior sidewalls shown in phantom lines;

FIG. 3 is an elevational cross-sectional view taken along line 3—3 of FIG. 1;

FIG. 4 is an elevational cross-section taken along line 4—4 of FIG. 1;

FIG. 5 is an enlarged fragmentary view of area 5 of FIG. 1;

FIG. 6 is a bottom and right-side perspective view of the display base of FIG. 1 and showing the registration notches in the spaced feet of the platform; and FIG. 7 is a side-elevational view of several display platforms in vertical registrable array and showing the access to the tine voids of a mechanical pallet handler device.

DETAILED DESCRIPTION OF PRESENTLY PREFERRED EMBODIMENT

Figure 1:
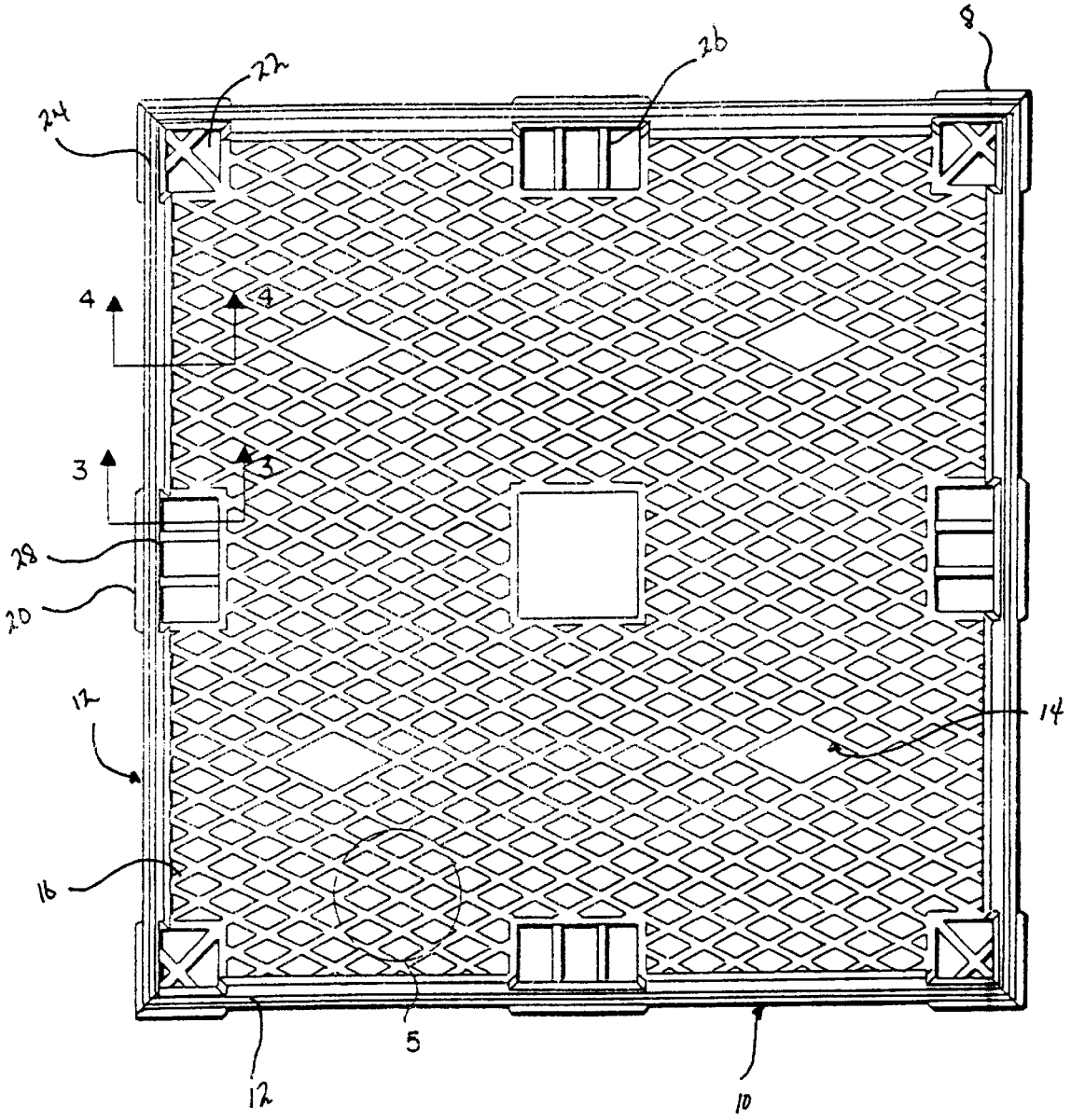
FIG. 1 is a top-plan view of the inventive display base.

Referring now to FIG. 1, inventive display base 10 is shown in plan view with platform surface 14 being composed of an open-weave or honeycomb 16 construction to permit the drainage of fluid through platform surface 14. As is often the case with display-base platforms, they are may be situated outside of convenience stores in order to present large and bulky items, such as cases of soft drinks, which would require a great deal of floor space. Since the products and the display-base platforms are exposed to the elements, it is not uncommon that rain or snow will build up on the product and display bases. Therefore, it is important that the display base not retain any fluid or moisture which collects on the display base due to the display base and product being positioned outside the store. The perforated or honeycomb 16 construction of platform surface 14 avoids the collection of rain water or melted snow or fluid from ruptured product containers and allows the fluid to drain away through the bottom of platform surface 14 thus avoiding damage to the bottom layer of product and contact with platform surface 14.

Referring now to FIGS. 1 and 2, sidewall 12 encloses platform 14 and extends upwardly for several inches from platform surface 14. Sidewall 12 not only serves to retain product on platform surface 14 when necessary, it also protects the lower levels of products closest to platform surface 14 from shopping carts and product handling devices. To allow purchasers to conveniently withdraw product that is in contact with platform surface 14 and below or partially below the level of the top of sidewall 12, the profile of sidewall 12 has been relieved at several points about the perimeter to allow a user to insert the hand or fingers down along the side of the product and remove it from platform surface 14.

These relief areas may be seen at corner reduced sidewall portion 24 and at side reduced sidewall portion 28 at which locations the thickness of sidewall 12 has been diminished to provide space for insertion of a user hand or fingers down along the sidewall 12. Depending on the height of the product, the hand or fingers may be inserted downwardly and into side access void 26 or corner access void 22 in order to grasp the product from its bottom and lift it upwardly and away from platform surface 14.

Referring now to FIG. 2, display base 10 of FIG. 1 is shown in side elevational view with phantom lines indicating the corner reduced sidewall portions 24 and the side reduced sidewall portion 28 and platform surface 14. In side elevational view, it is shown that two principle segments of display base 10 are present which are an upper portion generally demarcated by sidewall 12 and the lower portion generally including platform surface 14 and corner feet 18 and side feet 20. In the lower portion and separating corner feet 18 from side feet 20, are tine voids 39 which extend along the underside of platform surface 14 from one edge of display base 10 to the opposite edge of display 10 as shown in FIG. 6.

Still referring to FIG. 2, the upper portion of device 10 generally encompassing sidewall 12 is reserved for the display of product signage in signage display area 32 which extends along the entire side of sidewall 12. In one embodiment of the invention, signage display area 32 is a flat expanse which may be silk screened or painted or to which signage may be applied with an adhesive. It is important to appreciate, and as will be explained in detail hereinafter, that signage area 32 is a protected area, and that display base 10 is constructed in such a fashion that, during normal use, signage display area 32 will not come into contact with other portions of adjacent display bases 10 which might damage the signage in signage display area 32.

In particular, it should be appreciated that during a vertical stacking of display bases 10 as shown in FIG. 7 signage area 32 of each display base 10A, 10B or 10C is maintained at a spaced or separated distance from the adjacent display bases 10A, 10B or 10C thereby protecting the signage applied to signage display area 32. This is particularly important as over time when permanent signage is applied to display area 32, the rough treatment commonly given to display bases or pallets 10 will mar and damage the signage on signage display area 32 thus defeating a major principle of the invention which is to provide pleasing, reusable, display bases with signage thereon for display in store retail areas. Alternatively, in the use of pallets or storage bases which are compactly stored by inclusion of a "nesting" aspect, one portion of a first storage base will slide over and scrape against the signage portion of a second, adjacent storage base. Over time this nesting of storage bases will damage the applied signage. In addition, this one-inside-the-other system of nesting encourages difficulties in separating the pallets one from the other due to the tendency of the pallet to "stick" to each other.

Referring now to FIG. 3, a more detailed examination of reduced sidewall portion 28 is shown along with other features of the inventive display base 10. In FIG. 3, reduced sidewall 28 is shown in cross-sectional view with standard thickness sidewall portion 29 adjacent to the reduced sidewall portion 28. The additional space created at reduced sidewall area or portion 28 is sufficient to allow a user to grasp a product placed on platform surface 14 and to remove the product from display base 10. This is particularly important when the height of the product placed on display base 10 is lower than the overall height of sidewall 12 of display base 10. Therefore it is of particular convenience for a user to be able to reach down along the side of the product on platform surface 14 and grasp the side of the product in order to remove it from display base 10. Also shown in FIG. 3 are aspects of a second embodiment of display base 10 which permits the insertion and removal of separately manufactured signage into signage display area 32 (FIG. 2). In the alternate embodiment, flanges are incorporated along areas of sidewall 12 which serve to hold separately manufactured signage in place along sidewall 12. In FIG. 3 these flanges may be seen and are represented by lower signage retainer 34 and upper signage retainer 36. In the particular embodiment shown in FIG. 3, lower signage retainer 34 is actually molded with display base 10 at the time of manufacture of base 10. In order to ease the method of manufacture, upper signage retainer 36 is added onto display base 10 after the initial molding process. The absence of upper signage retainer 36 during the molding process eases the construction of the device and allows it to be more easily freed from the mold. The construction of upper signage retainer 36 may be of plastic or metal or other suitable material and it is fashioned in an elongate strip which may be secured to sidewall 12 at the appropriate position using adhesive or mechanical attachment devices or mechanical means or adhesive means. In the embodiment of FIG. 3, the inclusion of lower signage retainer 34 and upper signage retainer 36 permits separately produced interchangeable signage to be introduced into signage display area 32 as is needed by the retailer in order to properly promote and advertise end-of-aisle product displays.

Referring now to FIGS. 3 and 4, the thicker sidewall 12 of FIG. 4 may be compared with the reduced sidewall portion 28 of FIG. 3 to better appreciate the differentiation between the various sidewall portions to allow a user to remove product from display base 10. Also shown in FIGS. 3 and 4 is side elevational view of side foot 20 and in FIG. 4, corner foot 18. Examination of the side foot 20 and corner foot 18 areas of FIGS. 3 and 4 reveals the inclusion of registration notch 42 in each of side foot 20 and corner foot 18. Referring now to FIG. 6, the positioning of registration notches 42 about the entire perimeter feet of display base 20 may be observed. The inclusion of registration notches 42 will be discussed in detail hereinafter, however, it is important to appreciate that they serve to receive the upper rim 30 of sidewall 12, (FIG. 2) in order to maintain the proper spacial array when display bases 10 are stacked in vertical array as shown in FIG. 7 and to avoid the previously discussed contact of signage display area 32 by adjacent stacked display bases 10.

Referring now to FIG. 5, an enlarged fragmentary view of a portion of honeycombed 16 of platform surface 14 is shown. In a preferred embodiment, honeycomb 16 is molded with the entirety of display base 10. Alternatively, it will be appreciated that honeycomb or perforated surface 16 of platform surface 14 could be composed of a separate material of any composition and attached to the remaining portions making up display base 10.

In FIG. 6, a perspective elevational view of the bottom of display base 10 of FIG. 1 is shown in order to better appreciate the location of corner feet 18 and side feet 20 as well as a center support 21. Corner feet 18 and side fee 20 are placed about the perimeter of display base 10 and are spaced apart in order to create tine voids 38 therebetween. This spacing of feet is continued by the placement of center support 21 in the center of the underside of platform surface 14 in order to maintain the open voids of tine voids 38 which are created by the spaced placement of corner feet 18 and side feet 18 about the perimeter of platform surface 14. The spacing of the feet in order to create tine voids 38 allow the insertion of the tines of a pallet handler device into display base 10 from any side. Typically, previous forms of pallets permitted the insertion of the tines of a forklift or other product handler from only two sides of the pallet. Display base 10 permits the tines of a product handler device to be inserted from any side thus easing the manipulation of display base 10 in the close confines of a retail store.

Again referring to FIG. 6, the placement of registration notches 42 in corner feet 18 and side feet 20 will be discussed. In order to securely register together in vertical array, a multiplicity or plurality of display bases 10, it is important to have an engagement registration feature on each display base which permits secure attachment between upper and lower display bases 10 which are stacked in vertical array. One such vertical array stack may be seen in FIG. 7 where display bases 10A, 10B, and 10C are stacked in vertical array. Again, referring to FIG. 6, the achievement of a secure vertical array of display bases 10 is an important feature when placing the devices within the close confines of a retail store room. While the retailer would not wish to stack the display bases 10 over a safe height, even a height of 5 or 6 feet would contain sufficient display bases 10 that without a registration notch or connecting feature or attachment point 42 to keep the vertical array of display bases 10 from sliding off one another in sideways fashion, a danger would be presented to passersby. The present invention includes such an interlocking registration notch 42 to avoid just such a safety issue.

Referring again to FIG. 6, the registration notches 42 in corner feet 18 and side feet 18 are aligned and are properly sized and ordered to receivably engage upper end 30 of sidewall 12 (FIG. 2). Referring now to FIG. 7 and FIG. 6, it can be appreciated that engagement of registration notches 42 (FIG. 6) of display base 10B (FIG. 7) with upper rim 30 (FIG. 6) of display base 10C (FIG. 7) serve to lock together display base 10B and display base 10C with respect to lateral forces which might tend to push display base 10B laterally off of display base 10C. In similar fashion, the connection of display base 10A to display base 10B is accomplished. This interlocking of a vertical array 44 of display bases 10A, 10B, and 10C provides a far neater and safer arrangement of display bases than has been previously attained with conventional pallets or other modern pallets or display bases.

A further feature of inventive display base 10 which can be observed in FIG. 7 is the previously discussed spacial separation between display bases 10A, 10B, and 10C when stacked in vertical array 44 which keeps separation between any portions of display bases 10A, 10B, and 10C with respect to the adjacent signage display area 32 of each of such display bases. In this stacking arrangement, the adjacent display base 10B does not slide down over the signage display area 32 of display base 10C as in other display bases. In avoiding this nesting of the display bases by the inventive display base 10, and rather, relying upon an interlocking feature as between adjacent display bases 10B and 10C when stacked in vertical array the bases are securely joined together, however, the signage display area 32 is maintained at a safe scratch free distant from the adjacent display bases.

Continuing to refer to FIG. 7, it may be seen that when stacked in vertical array 44, each signage display area 32 of each display base 10A, 10B, and 10C may be clearly observed. This ability to observe signage area 32 is important as when a particular manufacturer of a product has provided a product display base 10 to be used with the manufacturer's particular product, it is important for the retailer to quickly and easily spot that particular display base containing the retailer's signage within the stack or vertical array 44 of display bases 10 so that particular display base can be removed and used with the new product display. In display bases which do not provide the separation between signage areas as does the inventive display base, the product signage cannot be observed and the entire vertical array of display bases must be dismantled while the retail worker tries to locate the appropriate product display base. In the present invention, this debility is eliminated.

In addition, the separation which is maintained between display bases 10 when stacked in vertical array 44 permits the function of tine voids 38 to be maintained for each display base 10A, 10B, and 10C when stacked in vertical array 44. As is shown in FIG. 7, tine voids 38 are unobstructed and are presented in operable fashion so that an operator of a pallet handling device may insert the tines of the device into any of tine voids 38A, 38B, and 38C in order to lift the portion of vertical array 44 which is above the base of interest, in this case base 10B, thereby allowing removal of only base 10B from vertical array 44 and allowing the remainder of vertical array 44 to be re-engaged with the base below base 10B, in this case base 10C to maintain storage of the vertical array. Therefore it can be appreciated that these features in combination provide a new and inventive display base 10 which incorporates signage and interchangeable signage and which prevents damage to the signage display areas of each of display bases 10 and which allows the display bases to be securely stacked in vertical array and which permits the independent removal of any one of any of the display bases which is stacked in vertical array through the use of the always visible and operable tine voids 38 of display base 10 whereby any particular display base 10 within vertical array 44 may be identified and removed from the stack by merely lifting away the display bases above the desired display base and without having to disassemble the entire stack of display bases.

According to one preferred embodiment of the invention intended for the display of 24 can beverage cases, the pallet is sized such that platform surface 14 is 33 inches by 33 inches. It has been determined that this sizing provides for stable product display by building the display using a 7-tie arrangement; i.e. when looking at a finished layer of a display stand so built, the long edges of two cases will face Side A of platform 14; the short edges of two cases as well as the long edge of one case will face Side B of platform 14, the short edges of three cases will face Side C of platform 14, and Side D will be as Side B. On the next higher level, the arrangement will be reversed such that the Arrangement on Side A will now be on Side C and vice-versa. This will result in a stable tying arrangement that will allow product to be readily visible, yet easily accessed.

Other sizes and arrangements are contemplated as well and may be readily practiced using the invention. One such possibility is a multi-sided display stand that would be free-standing and sized to accommodate 12 or 24 can cases of beverage with, for example, alternating facing of the short and then long edges of a case on each adjacent side of the display stand.

Materials, processes, compositions and the like used in making pallets such as those described herein are considered well-known in the art. See, for example, the discussions in the art cited and incorporated herein.

It will be appreciated that the detailed descriptions offered herein are merely illustrative of the invention and not offered by way of limitation.

Having thus described the invention what is claimed as new and desired to be secured by Letters Patent is as follows:

1. A product display base comprising:

a platform for placement of the product thereon, sidewalls extending upwardly from said platform to enclose said platform and to protect said product, said sidewalls terminating in an upper edge, feet extending from said platform to support said platform, said feet being spaced apart to allow insertion of handler tines, and means on said feet for engaging said upper sidewall edge of a lower display base to register said display bases in a vertical stack, said engaging means capturing a sufficient number of said upper sidewall edges to prevent shifting movement in all lateral directions of said stacked bases from said vertical stack, said feet vertically spacing said stacked bases for observation of all sidewalls by a user for location of a particular base within said stack and said feet maintaining sufficient separation between said sidewalls and said platforms of vertically adjacent display bases to permit handler tine insertion for stack separation and retrieval of the located display base from the stack.

2. The apparatus as claimed in claim 1, further comprising means for supporting a sign on said sidewall.

3. The apparatus as claimed in claim 1, further comprising indents on said sidewalls to permit insertion of the hand of a user to allow grasping of a product positioned on said platform.

4. The apparatus as claimed in claim 1, wherein said means for engaging comprises notches in the bottom of each foot for receiving said sidewall upper edge of a lower display base.

5. The apparatus as claimed in claim 1, wherein said apparatus is constructed of a molded plastic capable of withstanding heat or chemical sterilization.

6. The apparatus as claimed in claim 1, wherein said platform is porous to allow drainage of fluids therethrough.

7. A product display base comprising:

a platform for placement of the product thereon, sidewalls extending upwardly from said platform to enclose said platform and to protect said product, said sidewalls terminating in an upper edge, means for supporting a sign on said sidewalls, indents on said sidewalls to permit insertion of the hand of a user to allow grasping of a product positioned on said platform, feet extending from said platform to support said platform, said feet being spaced apart to allow insertion of handler tines, and means on said feet for engaging said upper sidewall edge of a lower display base to register said display bases in a vertical stack, said engaging means capturing a sufficient number of said upper sidewall edges to prevent shifting movement in all lateral directions of said stacked bases from said vertical stack, said feet vertically spacing said stacked bases for observation of all sidewalls by a user for location of a particular base within said stack and said feet maintaining sufficient separation between said sidewalls and said platforms of vertically adjacent display bases to permit handler tine insertion for stack separation and retrieval of the located display base from the stack.

8. The apparatus as claimed in claim 7, wherein said apparatus is constructed of a molded plastic capable of withstanding heat or chemical sterilization.

9. The apparatus as claimed in claim 7, wherein said platform is porous to allow drainage of fluids therethrough.

10. A product display base comprising:

a platform for placement of the product thereon, sidewalls extending upwardly from said platform to enclose said platform and to protect said product, said sidewalls terminating in an upper edge, feet extending from said platform to support said platform, said feet being spaced apart to allow insertion of handler tines, and notches in the bottom of each foot, said notches being engageable with said upper sidewall edge of a lower display base for registering said display bases in a vertical stack, said notches capturing a sufficient number of said upper sidewall edges to prevent shifting movement in all lateral directions of said stacked bases from said vertical stack, said feet vertically spacing said stacked bases for observation of all sidewalls by a user for location of a particular base within said stack and said feet maintaining sufficient separation between said sidewalls and said platforms of vertically adjacent display bases to permit handler tine insertion for stack separation and retrieval of the located display base from the stack.

11. The apparatus as claimed in claim 10, further comprising means for supporting a sign on said sidewall.

12. The apparatus as claimed in claim 10, further comprising indents on said sidewalls to permit insertion of the hand of a user to allow grasping of a product positioned on said platform.

13. The apparatus as claimed in claim 10, wherein said apparatus is constructed of a molded plastic capable of withstanding heat or chemical sterilization.

14. The apparatus as claimed in claim 10, wherein said platform is porous to allow drainage of fluids therethrough.

15. A product display base comprising:

a platform for placement of the product thereon, said platform having a porous bottom to allow drainage of fluids therethrough, sidewalls extending upwardly from said platform to enclose said platform and to protect said product, said sidewalls terminating in an upper edge, means for supporting a sign on said sidewalls, indents on said sidewalls to permit insertion of the hand of a user to allow grasping of a product positioned on said platform, feet extending from said platform to support said platform, said feet being spaced apart to allow insertion of handler tines, and notches in the bottom of each foot, said notches being engageable with said upper sidewall edge of a lower display base for registering said display bases in a vertical stack, said notches capturing a sufficient number of said upper sidewall edges to prevent shifting movement in all lateral directions of said stacked bases from said vertical stack, said feet vertically spacing said stacked bases for observation of all sidewalls by a user for location of a particular base within said stack and said feet maintaining sufficient separation between said sidewalls and said platforms of vertically adjacent display bases to permit handler tine insertion for stack separation and retrieval of the located display base from the stack.

16. The apparatus as claimed in claim 15, wherein said apparatus is constructed of a molded plastic capable of withstanding heat or chemical sterilization.

* * * * *